United States Patent [19]

Lorang

[11] 4,252,319

[45] Feb. 24, 1981

[54] GOLF SWING FORCE SEQUENCE TRAINING APPARATUS

[76] Inventor: Walter R. Lorang, 2239 W. Maple Rd., Walled Lake, Mich. 48088

[21] Appl. No.: 37,927

[22] Filed: May 10, 1979

[51] Int. Cl.[3] ..... A63B 69/36

[52] U.S. Cl. ..... 273/186 A; 273/165

[58] Field of Search ..... 273/81 D, 165, 186 A, 273/183 D, 194 R, 193 B

[56] References Cited

U.S. PATENT DOCUMENTS 1,942,922 1/1934 Gerow ..... 273/165

*Primary Examiner*—George J. Marlo

*Attorney, Agent, or Firm*—William T. Sevald

[57] ABSTRACT

Golf swing training apparatus for advising a player of the sequence of the force factors in the swing of a club in a golf shot comprising a housing having an upper end flexibly mountable on the shaft of a club at a point adjacent the top of the off-target hand and a lower end at the bottom of the off-target hand in gripping the club. The upper end is movably attached to the shaft to allow the housing to rock on the shaft away from and toward the target during the swing. The housing separates the player's off-target hand from direct contact with the shaft and the housing's rockability disassociates off-target side direct control and direct application of force on the shaft during the backswing and the first part of the downswing. This tends to substantially reduce off-target side influence in the swing leaving the player in the position where he is influenced to exert initial dominant control and force of the swing through his target side. A lower bead is provided for locating the apparatus in the off-target hand at the first joint of the fingers and not on the palm. Radial flanges are provided for centering the "V" between the thumb and forefinger of the off-target hand on the shaft.

2 Claims, 13 Drawing Figures

Fig-6
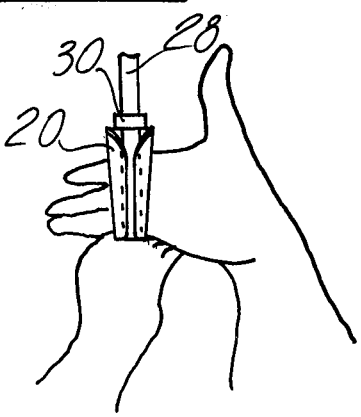
Fig-7
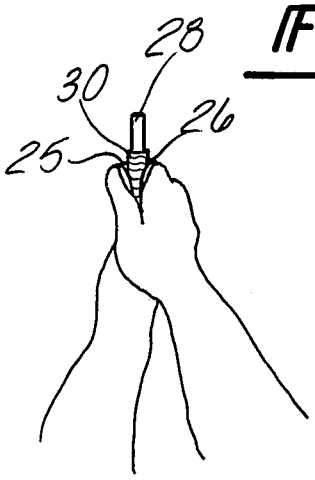
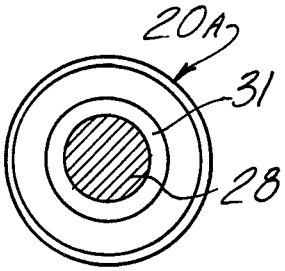
Fig-9
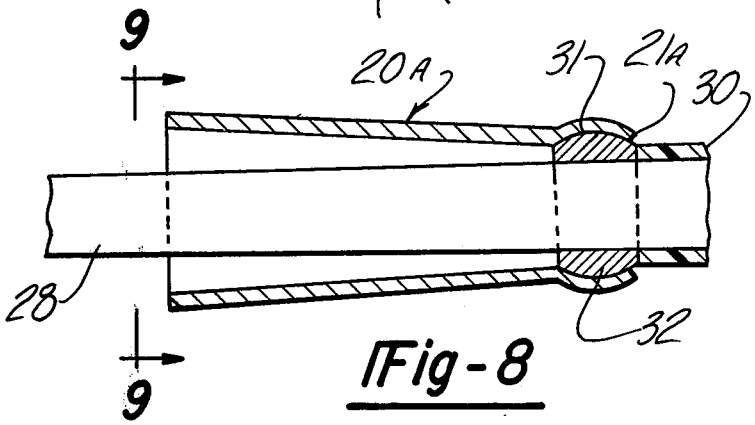
Fig-8
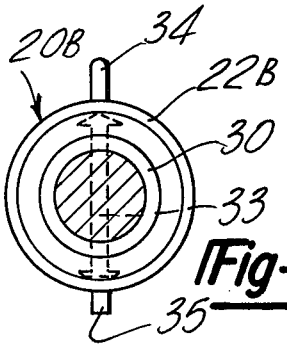
Fig-11
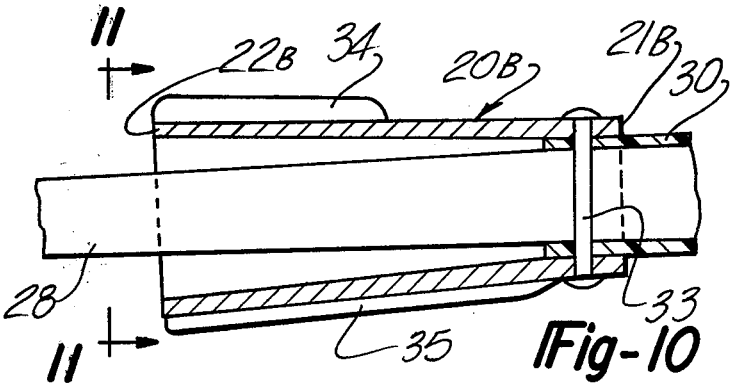
Fig-10
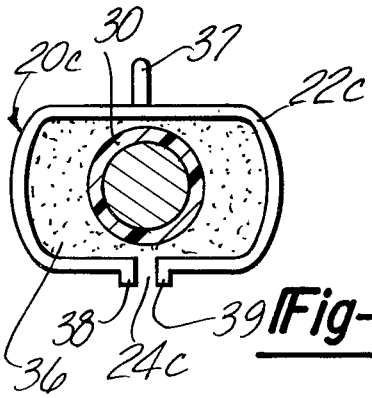
Fig-13
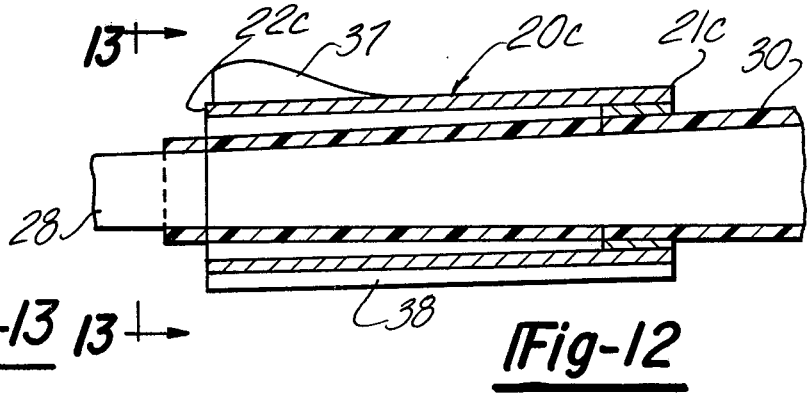
Fig-12

GOLF SWING FORCE SEQUENCE TRAINING APPARATUS

BACKGROUND OF THE PRESENT INVENTION

Many of the experts describe golf as a game of opposites and contradictions. By this they mean that in the ordinary import of things, that which seems to be reasonably correct is usually wrong. On the entire backswing and the downswing to waist high on the off-target side, the target side should control dominantly. In the follow-through from waist high to finish on the target side, the off-target side should control. Thus the sides cross one another at the beginning and finish of the swing. Only from waist high down on the downswing to and through ball impact and from impact to waist high on the foreswing are both sides joined in the force of the swing. Thus the forces exerted in the swing of a golf club and the body members exerting same seem to come within the aforesaid description.

The difficulty arises in the opposites and contradictions facing the player leaving him in a condition where he can't tell which side is dominant or subservient in controlling his swing at various points. The coach, pro or book tells him to take his right side, for a right handed player, out of the back swing and part of the downswing. But the player himself can't tell when he is or when he isn't. Only the super skilled can tell and usually a lot of the time they can't tell what they are doing in their own swing and they have to go to their pro for an analysis and critique. The best have to do this. The ordinary 100 shooter doesn't have a chance.

When the ball is struck, it resiliently flattens in the impact area and then springs back against the club head. The force of the spring-back is dependent on the resistance of the club head. If the club head speed is decelerated at impact, the projecting resistance is diminished. If the club head speed continues to accelerate, the projecting resistance is increased. Thus continued acceleration of club head speed is an essential.

As a player apparently swings a club with two hands, wrists, arms and sides, it would seem that these portions should be applied equally at all points in the swing. But the experts say and prove that this is wrong. They show that the hand, wrist, arm and side facing the target should dominate on the backswing and on the down swing to a point where the hands are about waist high, and the other should be subservient. At waist high in the downswing the off-target hand begins to exert influence. As the club head approaches the ball, the off-target hand influence increases to equilibrium prior to impact, through impact, and after impact with the ball in the follow-through to a point about waist high. At waist high in the follow-through, the influence of the target hand diminishes and becomes subservient to the off-target hand. The off-target hand then decelerates the swing from about the waist high point in the follow-through.

If the off-target side pulls the club up on the backswing and pushes it down at the start of the downswing it has taken over and the swing cannot be executed properly because the off-target side is in control and won't relinquish it. Contrariwise, if the target side dominantly pushes the club up on the backswing, pulls it down on the down swing to waist high, the target side then can now pull the club into impact, through impact, and through the follow-through toward the target with the off-target side joined from waist high. With the target side pushing the club up on the backswing, the target side dominant control is initiated. With the target side pulling the club down on the downswing to waist high, target side dominant control is continued. With the off-target side joining at waist high, both sides accelerate club head speed prior to, at, and after contact with the ball and during the follow-through to waist high. Thus club head speed is continually accelerating from the top of the swing all the way through to waist high on the follow-through. From waist high on the follow-through to the finish, the target side brakes the speed of the club.

SUMMARY OF THE PRESENT INVENTION

To the end of demonstrating a player's swing to the player himself so that he knows what he is doing, the present invention provides an apparatus by which the player can measure, gauge, and/or indicate his swing to himself. It gives him the feel in his own hands and sides of a proper swing. It also advises him of an improper swing. It demonstrates to him that his stronger off-target side is the problem on the backswing and the first part of the downswing. It demonstrates to him that his weaker target side is his salvation at these points as hereinafter set forth. For left-handed players, the opposite or reverse applies.

A housing about the size of a human hand has an upper end facing the top of the club and a lower end facing the club head. The housing surrounds the shaft of a golf club in the position of the golfer's off-target hand. The housing is spaced from the shaft overall or at its lower end. The upper end is flexibly secured to the club shaft to allow rocking motion of the housing relative to the shaft. The player lightly grips the housing with his off-target hand and firmly grips the shaft with his target hand. In his grip of the club, the player's off-target hand is thus prevented from directly grasping the shaft and the shaft is able to rock within the housing. In the player's backswing of the club, his target hand, arm and reverse shoulder turn push the club up lightly pressed against off-target hand resistance which rocks the housing so that its off-target wall portion moves against the shaft on the off-target side. This condition must be vigorously maintained at the top of the backswing.

In a right-handed player's downswing, his target hand, arm and foreward shoulder turn pulls the club down with the off-target hand still lightly pressed against the housing, with the off-target side wall of the housing lying against the shaft on the off-target side with the target side wall spaced from the shaft to a point about waist high. The player's off-target hand is thus subservient on the backswing and at the top, giving the target side dominant control to start the downswing. The target hand, arm and foreward shoulder turn starts to pull the club down on the downswing with the off-target hand still only lightly pressed against the housing to maintain the housing's contact with the shaft on the off-target side to a point about waist high. At this point the off-target side joins in swinging club and club head speed is accelerated by both sides in the downswing from waist high to prior to and at contact with the ball and to a point in the follow-through to about waist high.

This provides the increasing resistance in the club head to the load against it occasioned by the contact with the ball, flattening the ball against the club head, and the reverse forces of the resilience of the flattened ball impinged on the club head to impart to the ball the full maximum energy of the moving club head to propel the ball a maximum distance of the particular club being used.

At a point prior to contact, the off-target side is now fully joined in the swing and starting to whip the shaft so that the housing rocks out of contact with the shaft on the off-target side and makes contact with the shaft on the target side of the shaft. The player feels this shift. This indicates that the target side has been dominant and that now the off-target side has joined in to whip the swing at the proper point.

The apparatus provides a means to train a player to use his normally weaker target side hand, arm and shoulder turn as dominant control on the back swing and down swing to waist high by demonstrating to him that his normally stronger off-target side hand, arm and shoulder turn constitute destructive interference to his swing at these points by providing means to show the lack of need of the off-target side forces at these points to accomplish a good golf shot.

The structure, operation and result of the apparatus of the invention will be more clearly understood from the later detailed description of the exemplary embodiments of the invention taken in connection with the attached drawings, now described.

DESCRIPTION OF THE DRAWINGS

FIG. 6 is a miniaturized view of the apparatus as seen in FIGS. 4 and 5 illustrating the initial application of the player's off-target hand to the apparatus at the first joint of the fingers and outwardly of the palm of the hand of a right handed player and showing the shaft foreshortened and the hands and forearms of the player diagrammatically.

FIG. 7 is a smaller scale view, similar to FIG. 6, illustrating the closed grip of the off-target hand with the flanges pointing into the "V" between the thumb and forefinger of the off-target right hand of a right handed player.

FIG. 8 is a view similar to FIG. 3 showing an unslotted housing and a swivel mounting of the apparatus including a truncated ball on the shaft co-acting with a truncate spherical socket of the apparatus.

FIG. 9 is a view similar to FIG. 2 taken on the line 9—9 of FIG. 8.

FIG. 10 is a view similar to FIG. 3 showing an unslotted housing, a pivot pin mounting, a single upwardly extending centering flange, and a downwardly projecting bead.

FIG. 11 is a view similar to FIG. 2 taken on the line 11—11 of FIG. 10.

FIG. 12 is a view similar to FIG. 3 showing a housing oppositely slotted to that seen in FIGS. 1–7 including an upwardly extending centering flange, and an elastic gasket for slipping axially over the club shaft and for gripping the shaft and rockably securing the housing when in position and a downwardly projecting bead formed at the slot; and FIG. 13 is a view similar to FIG. 2 taken on the line 13—13 of FIG. 12.

DETAILED DESCRIPTION OF THE ILLUSTRATED EMBODIMENTS

Figure 1:
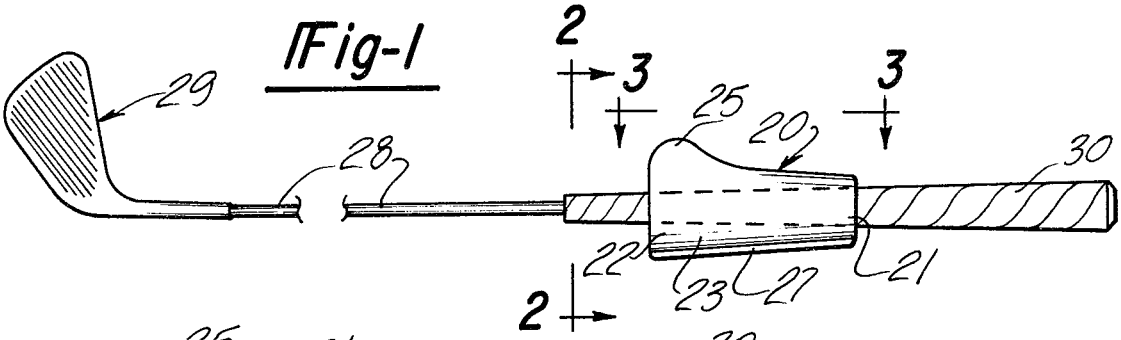
FIG. 1 is a side elevational view of one embodiment of the apparatus mounted on a golf club, with the club shaft foreshortened.
Figure 2:
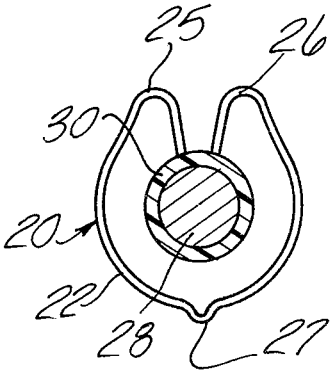
FIG. 2 is an enlarged end elevational view of the apparatus taken on the line 2—2 of FIG. 1, showing a longitudinal slot in the housing and radial flanges in more detail, showing the bead opposite the slot; and showing the shaft and handle in cross-section.
Figure 3:
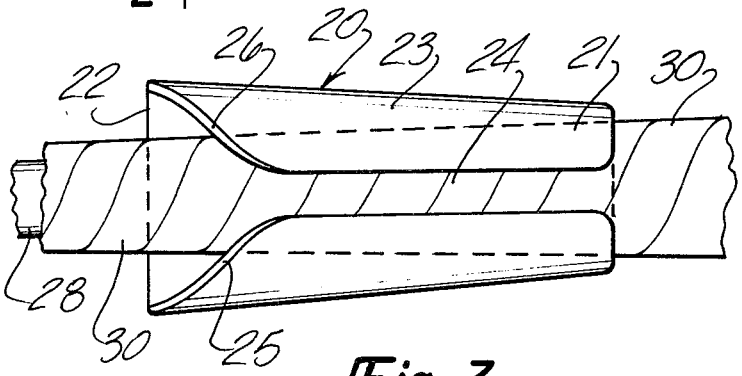
FIG. 3 is an enlarged top plan view of the apparatus seen in FIG. 1 taken on the line 3—3 thereof showing the longitudinal slot, the flanges, and the spring torsion clamping securement of the housing on the shaft of the club; and showing the shaft in elevation and foreshortened at both ends of the apparatus.
Figure 4:
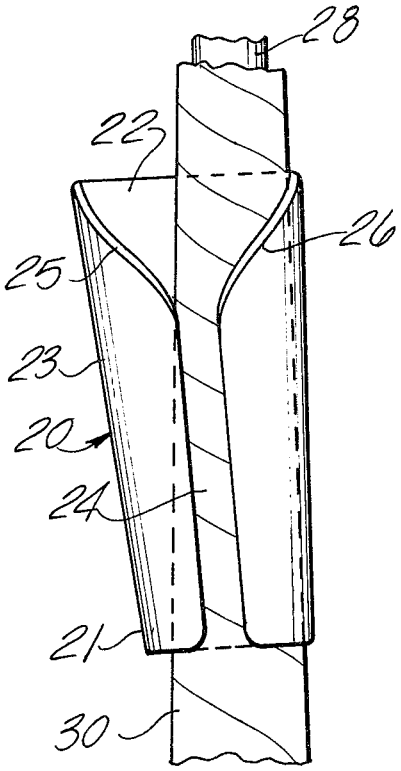
FIG. 4 is a plan view similar to FIG. 3 of the apparatus as seen by a right handed player looking down thereon illustrating that the housing is abutting the off-target side of the shaft under the controlling dominance of the target side and the slight resistance of the off-target side during the backswing, at the top, and during the downswing to a point about waist high to give the player the feel of target side dominance and off-target side subservience during said portions of the swing.
Figure 5:
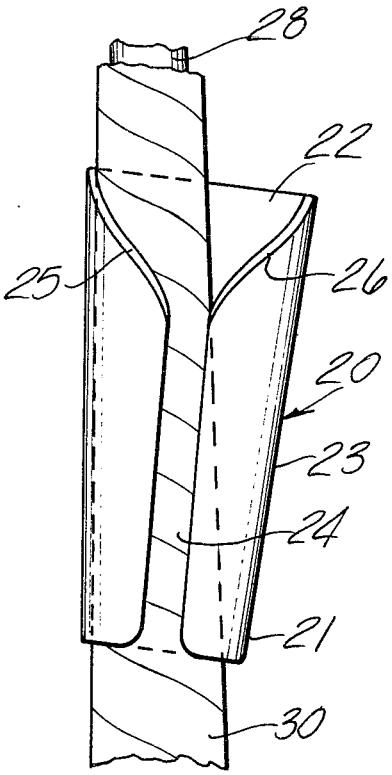
FIG. 5 is a view similar to FIG. 4 illustrating the rocking motion of the housing swung to abut the shaft on the target side under whipping motion imparted by the joinder of the off-target side of a right handed player during the swing from a point about waist high and prior to impact, at impact, and during the follow-through to give the player the feel of proper joinder of the target side at the correct point in the swing.

Referring now to the drawings wherein like reference numerals refer to like and corresponding parts throughout the several views, the exemplary embodiments of the invention shown therein comprise, FIGS. 1–7, a housing 20 having an upper end 21, a lower end 22 and a mid section 23 lying between the ends 21 and 22. A lengthwise slot 24 is formed in housing 20 and flanges 25 and 26 are formed on the housing 20 leading radially outwardly from the slot 24 at the lower end 22. A radially extending longitudinal bead 27 is formed in the bottom of the housing 20. The housing 20 is placed on the shaft 28 of a club 29 by sliding the shaft through the slot 24 at a thin portion of the shaft 28. The upper end 21 is then slid up the shaft 28 to the position of the off-target hand on the leather handle 30. The upper end 21 is thus springwise torsionally clamped on the leather handle 30. The housing 20 is thus mounted on the club 29 with the springwise clamp of the housing 20 on the leather handle 30 permitting the housing 20 to swing from side-to-side as seen in FIGS. 4 and 5. A player places his off-target hand on the housing 20 with the bead 27 at the first section or joint of the fingers and outwardly of the palm of his hand as shown in FIG. 6. He then closes his hand to the position seen in FIG. 7 so that the flanges 25 and 26 abut the thumb and forefinger of his off-target hand with the convergence of the flanges 25 and 26 pointing to the "V" between the thumb and forefinger.

In the embodiment of FIGS. 8 and 9, the housing 20A has an upper end 21A with a truncated ball recess 31 which fits on a truncated ball 32 surrounding the shaft 28 rockably mounting the upper end 21A as seen in FIGS. 4 and 5. The housing 20A is unslotted and does not have a bead for locating the fingers of the off-target hand and does not have flanges for guiding the thumb and forefinger of the off-target hand.

In the embodiment of FIGS. 10 and 11, a pivot pin 33 extends transversely through the shaft 28 and handle 30 and the upper end 21B of the housing 20B has apertures receiving the pivot pin 33; this rockably mounts the housing 20B on the shaft 28 as seen in FIGS. 4 and 5. A single centering flange 34 is provided to guide the thumb and forefinger of the off-target hand to proper position with the flange 34 pointing to the "V" between the thumb and forefinger as seen in FIG. 7. A bead 35 is annexed to the housing 20B for properly locating the fingers of the off-target hand as seen in FIG. 6.

In the embodiment of FIGS. 12 and 13, a foam rubber or other resilient gasket 36 lies between the internal diameter of the upper end 21C and the leather handle 30. The housing 20C is a rounded corner, rectangular shape in cross-section. A centering flange 37 is annexed to the top of the housing 20C to position the thumb and forefinger of the off-target hand to point to the "V" formed by the thumb and forefinger in the grip. A slot 24C is formed in the housing 20C and longitudinal beads 38 and 39 project radially at the slot 24C. The beads 38 and 39 position the fingers of the off-target hand in proper location on the housing 20C. The slot allows the housing 20C to be slid radially over a thin section of the shaft 28 to mount the housing 20C on the club 29. The gasket 36 being resilient, is expandable to slide on the shaft at the top end of the club 29. The gasket 36 is out-size or larger than the interior of the upper end 21C of the housing 20C so that the gasket 36 is resiliently compressed between the housing 20C and the leather handle 30. Cement or bonding material may be used between the gasket and the housing and/or shaft 28 or handle 30 to further enhance the security of the mounting. The shape of the housing 20C insures that when the thumb and forefinger are located by the centering flange 37, that the palm is well off the beads 38 and 39 with the beads 38 and 39 lying in the fingers of the off-target hand.

The embodiments of FIGS. 1–7 and 12–13 are slipable radially over the shaft. The embodiments of FIGS. 8–9 and 10–11 are mountable in the making of the club or by disassembling a portion of the club. The clamping force of the embodiment of FIGS. 1–7; the ball joint of the embodiment of FIGS. 8–9; the pivot pin embodiment of FIGS. 10–11; and the resilient gasket of FIGS. 12–13; all mount the housing in various ways but so that it may rock relative to the shaft as shown in FIGS. 4 and 5.

With the apparatus of the invention on the club shaft and properly gripped by the off-target hand of the player, the player is handicapped to exert off-target side force and control in the backswing, at the top, and the start of the downswing of the club thereby requiring him to exercise target side force and control to dominate his swing of the club at these points. The invention thus trains the player to exercise target side dominance in the initiation of his swing.

The apparatus of the invention leads the player's target side into the swing—trains him to exercise initial control, force and influence with his target side; builds up his target side—exercises his target side force, control and influence in his swing of the club until it is strong in the back swing, at the top and at the start of the downswing. It gives him a target side he should have. This is the positive influence of the apparatus of the invention. The positive influence of the apparatus adds to target side force and control in said portions of the swing. The rocking shift initially of the housing on the backswing as seen in FIG. 4 tells the player he has pushed the club up on the backswing with his target side maintaining said position at the top tells the player he has not relaxed his off-target side grip and dominance. Maintaining said position on the start of the downswing to about waist high tells the player he is executing his swing properly.

The negative influence of the apparatus is also very important. If the housing does not shift on the backswing to abut the off-target side as seen in FIG. 4, the player can tell he is pulling the club up with his off-target side. If the housing shifts at the top of the backswing, he can tell that he relaxed his target side dominance and has lost his proper grip. If the apparatus shifts to abut the target side of the shaft as seen in FIG. 5 prior to his downswing reaching about waist high he can tell that his off-target side has come into play too soon. If the apparatus has not so shifted to abut the target side of the shaft as seen in FIG. 5 prior to contact with the ball, he can tell that he brought his target sideinto his swing too late.

Thus the appearance tells the player when he is executing his swing properly and when he is executing his swing improperly. Both are very important.

While only a few of the possible embodiments capable of disclosing the invention have been shown and described in detail, it will be understood that other modifications may be made within the limits of the appended claims which define the scope of the protection of the invention.

I claim:

1. A housing comprising a one part body having a smaller upper end and a larger lower end; said housing being positionable on the shaft of a golf club with the upper end facing the top of the club and the lower end facing the club head;

said housing being located lengthwise on the shaft in the position of the off-target head of a player;

means pivotally securing said housing on the shaft of the club for rocking motion of said housing between a position inclining away from the target and abutting the shaft and a position inclining toward the target and abutting the shaft;

said means comprising said housing having a longitudinal wall separation extending through its said upper end to and through its said lower end; said housing being made of flexible material such as metal or plastic to provide torsion-spring characteristics in said body; said smaller end being diametrically smaller than the shaft upon which it is mounted so that said body is forcibly spread at said longitudinal separation in mounting said body on a shaft to grip the shaft at said smaller end of said body under torsion-spring-load to mount said body on a shaft independently of a player; and paired spaced flared radially projecting flanges leading from said wall separation at said lower end forming a V-shaped abutment fitting between the thumb and fore-finger to aid in positioning a player's off-target hand on said body;

a player places his target hand on the club shaft in his target hand grip and places his off-target hand on said housing in his off-target hand grip;

on his backswing of the club, the player pushes the club up with his target hand, arm and shoulder turn against slight resistance of his off-target hand, arm and shoulder turn (in the pro-press) whereupon the player "feels" the housing move against the off-target side of the shaft advising him that his target side is dominant;

at the top the player maintains said condition;

on his down swing the player pulls the club down with his target hand, arm and reverse shoulder turn against slight force against said housing exerted by his off-target hand, arm and shoulder turn so that said housing maintains its position abutting the shaft on the off-target side of the club so that the player feels the shaft continue to abut said housing on the off-target side of the shaft to a point about waist high;

with the off-target side joining in the swing at the point in the swing about waist high, the player feels the housing pivot away from its prior position and swing to a position abutting the shaft on the target side advising the player that his off-target side joined in the swing at the correct point;

conversely, if the player does not feel said housing so shift or if said housing shifts at the top of the backswing, the player can tell he is executing his swing improperly.

2. In apparatus as set forth in claim 1, at least one longitudinal bead on said housing extending radially outwardly therefrom and located to lie below the shaft of a club; said bead providing a guide for locating the fingers and palm of the off-target hand.

* * * * *